US006809645B1

(12) United States Patent
Mason

(10) Patent No.: US 6,809,645 B1
(45) Date of Patent: Oct. 26, 2004

(54) SYSTEM AND METHOD FOR UPDATING A PRODUCT DATABASE BASED ON SURVEILLANCE TAG DETECTION AT A SELF-CHECKOUT STATION

(75) Inventor: Timothy E. Mason, Buford, GA (US)

(73) Assignee: NCR Corporation, Dayton, OH (US)

( * ) Notice: Subject to any disclaimer, the term of this patent is extended or adjusted under 35 U.S.C. 154(b) by 47 days.

(21) Appl. No.: 10/232,455

(22) Filed: Aug. 30, 2002

(51) Int. Cl.[7] ..... G08B 13/14

(52) U.S. Cl. ..... 340/572.1; 340/572.3; 235/385

(58) Field of Search ..... 340/572.1, 572.3; 235/385; 705/21, 22, 23, 24

(56) References Cited

U.S. PATENT DOCUMENTS

| | | | | |
|---|---|---|---|---|
| 4,141,078 A | | 2/1979 | Bridges, Jr. et al. | 364/900 |
| 4,458,802 A | | 7/1984 | Maciver et al. | 194/4 R |
| 4,812,629 A | | 3/1989 | O'Neil et al. | 235/383 |
| 5,007,518 A | | 4/1991 | Crooks et al. | 194/212 |
| 5,095,195 A | | 3/1992 | Harman et al. | 235/381 |
| 5,500,640 A | | 3/1996 | Zhou et al. | 340/572 |
| 5,594,228 A | * | 1/1997 | Swartz et al. | 235/383 |
| 5,777,884 A | | 7/1998 | Belka et al. | 364/478.13 |
| 5,814,799 A | | 9/1998 | Swartz et al. | 235/383 |
| 5,979,758 A | | 11/1999 | Swartz et al. | 235/383 |
| 5,990,794 A | * | 11/1999 | Alicot et al. | 340/573.1 |
| 6,025,780 A | | 2/2000 | Bowers et al. | 340/572.3 |
| 6,169,483 B1 | | 1/2001 | Ghaffari et al. | 340/572.3 |
| 6,232,870 B1 | * | 5/2001 | Garber et al. | 340/10.1 |
| 6,333,692 B1 | | 12/2001 | Andersen et al. | 340/572.1 |
| 2002/0067267 A1 | * | 6/2002 | Kirkham | 340/572.7 |

* cited by examiner

*Primary Examiner*—Jeffery Hofsass
*Assistant Examiner*—Jennifer Stone
(74) *Attorney, Agent, or Firm*—Maginot Moore & Beck LLP; Paul W. Martin

(57) ABSTRACT

A system modifies the status of a surveillance tag indicator in a product data record corresponding to an article being processed at checkout stand. The system comprises a product database having product records corresponding to articles sold in a store, a surveillance tag interrogator associated with the checkout station that generates a surveillance tag present signal in response to detection of a surveillance tag, and a database modifier communicatively coupled to the database and the interrogator for modifying a surveillance tag indicator of a product record in response to the surveillance tag present signal from the interrogator. The database modifier, in response to the surveillance tag present signal, may set the surveillance tag indicator of a product record corresponding to an article being processed for checkout to indicate a surveillance tag is expected for the article thereafter. Subsequent queries of the product database using the barcode or other product identification data for the article retrieve a product record with an active surveillance tag indicator. One or more interrogators may be included in the system. Preferably, two interrogators are used with one being associated with the EAS deactivator of the checkout stand and the other being associated with the bag well of the checkout stand. Thus, the database modifier of the present invention updates the surveillance tag indicator to an active status in response to the unexpected detection of a surveillance tag being attached to the article being processed.

14 Claims, 9 Drawing Sheets

SYSTEM AND METHOD FOR UPDATING A PRODUCT DATABASE BASED ON SURVEILLANCE TAG DETECTION AT A SELF-CHECKOUT STATION

FIELD OF THE INVENTION

This invention relates generally to article surveillance tags and, more particularly, to the deactivation of article surveillance tags at checkout stations.

BACKGROUND OF THE INVENTION

Self-checkout stations at grocery stores and other retail stores are well known. The stations permit a consumer to scan articles for purchase so the station may identify the articles and a corresponding price. When the consumer indicates all articles for purchase have been presented to the terminal, a sub-total is accumulated, any taxes and discounts are computed, and a total amount due is displayed for the consumer. The station then allows the consumer to select a payment method. The station presents menu selections to the consumer so funds may be transferred to the retailer's account. Upon confirmation of payment, the articles are released to the consumer.

A self-checkout station typically includes a terminal, a scanner and scales for reading unit price codes (UPC) and determining article weight, a cashier keypad and display, a POS terminal for payment entry, a receipt printer, a change unit, and a checkout area for holding articles once they have been scanned. The terminal also includes a display, a processor, memory, programmed instructions, and data peripherals to control the operations of the station. The programmed instructions may contain modules for querying for article prices, computing totals and performing other functions related to the purchase of articles through a self-checkout station. Some checkout stations may also include a security application program that uses data from sensors such as scales to reduce the likelihood that the consumer leaves without scanning all of the articles or exchanges scanned articles with more expensive articles that have not been scanned.

Typically, two or more self-checkout stations are located proximately to one another with a checkout attendant station nearby. The checkout attendant may help consumers who may be using a self-checkout station for the first time, who are having trouble with scanning an article, or who are having difficulty with a payment method or the like. That is, the primary duty of the attendant is to provide assistance to customers who are using the self-checkout stations so they are efficiently used and quickly process customers with their checkouts. Although these attendants are available to assist in security monitoring, such duties actually detract from the performance of their primary duty.

In some retail stores, electronic article surveillance (EAS) systems are used to detect the unauthorized removal of merchandise from the store. EAS systems include surveillance tags that may be attached to articles of merchandise and detection devices that sound an alarm upon detection of a tag. The detection devices are typically located at the doorways of the retail store to reduce the likelihood that the articles are removed from the store without authorization. For articles bearing such tags that are properly purchased at a self-checkout counter, the consumer may present the articles to a checkout attendant who either deactivates the tag or mechanically removes the tag from the article. The removal or deactivation of the tag from a purchased article allows the consumer to proceed past the detection device located at a store exit without activation of an alarm unless the consumer has concealed articles having tags for which the consumer did not pay.

The tags that may be attached to articles of merchandise are well-known and include radio frequency tags, magnetic tags, microwave tags, and resonant tuned tags. The radio frequency, microwave, and resonant tuned tags typically include a fusible link that may be disconnected to deactivate the tag by altering the characteristics of the electrical circuit in a tag. At least two known methods are used to rupture fusible links. One method radiates the tag with radio frequency energy at a power level sufficient to rupture the fusible link while the other method uses a deactivation frequency to open the fusible link in a multi-frequency resonant tag circuit. These methods may be used to deactivate a tag that uses a radio frequency circuit. Other tags may use magnetic components and appropriate degaussing methods may be used to deactivate such tags. Typically, magnetic tags include two magnetic circuit components and one of the magnetic circuit components may be selectively magnetized or degaussed. A magnetic EAS tag deactivator may degauss or magnetize the circuit component that has the alterable magnetic characteristic so that the tag no longer responds to the tag interrogation signal emitted by a tag detection device. Of course, tags may also be deactivated by methods that physically remove a tag from an article.

Previously known systems have included tag deactivators in checkout counters for deactivating EAS tags during checkout. For example, U.S. Pat. No. 6,154,135 discloses a bagging area in which a scanner is proximately mounted at the opening of the bag well and a tag deactivator is located at the bottom of the bagging area. When the checkout attendant reaches a hand towards the bag rails extending outwardly from the bag well to remove the bag being filled, a capacitor in a circuit associated with the bag rail senses the attendant's approach and triggers the deactivator. In response, the energized deactivator applies a signal that deactivates the EAS tags attached to articles in the bag above the tag deactivator. U.S. Pat. No. 6,102,290 requires the deactivator to include an indicia reader so that an identification code located on the EAS tag being deactivated may be compared to an identification code read from a hanger tag. This comparison verifies that the tag being deactivated is indeed the one attached to the last article scanned. U.S. Pat. No. 5,059,951 is directed to an integrated barcode scanner and tag deactivator that may be coupled to one another to make sure that the data capturing and tag deactivation functions are completed before an article is given to a consumer. U.S. Pat. No. 5,341,125 describes an EAS tag detector that generates a signal to activate an EAS tag deactivator in response to detection of an EAS tag and that helps one orient the EAS tag for effective deactivation. U.S. Pat. No. 6,102,290 discloses a system that selectively enables EAS tag deactivation so tag deactivation cannot occur until the bar code corresponding to the tagged article has been scanned at the self-checkout station. The enabling of the EAS deactivation device requires correspondence between a symbol read from a hanger tag and a symbol read from the surveillance tag. Also, U.S. Pat. No. 6,333,692 is directed to a system that uses data scanned from an article to query a database and determine whether a surveillance tag should be deactivated. The deactivator is energized in response to the database indicating the scanned article should have a surveillance tag. Deactivations are counted and discrepancies between the number of tagged articles scanned and the number of deactivations performed is sent to an in-store processor for storage and audit processing.

While all of these patents address the deactivation of EAS tags after the articles to which the tags are attached are scanned for product information, they do not facilitate deactivation of EAS tags on articles identified in the product database as not having an EAS tag. For example, the system of the '692 patent activates the EAS deactivator in response to a database record that indicates that a scanned article should have an EAS tag so it may evaluate whether the expected EAS tag deactivation occurred. Consequently, the attachment of an EAS tag to an article that is not identified by the product database has having an EAS tag would not activate the EAS deactivator and a mismatch condition would result. The mismatch would occur because the deactivation of the EAS tag in this scenario would not be expected so the actual deactivations would be greater than the expected number of deactivations. The system of the '780 patent constructs a product database from surveillance tags prior to placement of the articles in the retail space of a store. Consequently, only articles to which EAS tags are attached have data records in the database and the processing of articles without EAS tags at the checkout station of the '780 patent occurs without reference to data stored in the product database. Thus, previously known checkout stations that interrogate a product database data regarding attachment of a surveillance tag to a scanned article, do not facilitate deactivation of EAS tags on articles for which no corresponding database record is returned or surveillance tag is expected.

While some vendors attach surveillance tags before sending them to a retail establishment, others do not. After receiving articles that do not have attached EAS tags, the retailer may attach surveillance tags. The decision to apply surveillance tags to an article may be affected by several considerations. For example, the number of units stocked in the store, the feasibility of physically attaching a tag to the article, or the amount of shrinkage occurring for the article may affect the decision to attach tags to the article. These and other such factors are considered by a retailer before the retailer determines that the expense of attaching surveillance tags and of dealing with their removal at checkout is worthwhile. In some instances, a department manager may make the decision without initiating the procedure to update the product database to include that information or may implement the decision before the database is updated. Consequently, systems that use a surveillance tag indicator stored in the product database to activate an EAS tag deactivator do not enable the EAS deactivator for the EAS tags attached to such articles. The EAS tag deactivation for the surveillance tags attached to articles not having a corresponding surveillance tag indicator in the database require offline processing during checkout. Systems that count discrepancies between data elements that indicate a surveillance tag should be attached to an article and the number of actual occurrences of EAS tag deactivations simply report the discrepancy without updating the product database.

In some previously known POS transaction systems, articles having labels with barcodes or other indicia that may be read by a barcode scanner may not have a corresponding data record in the product database. To process the article through checkout, the checkout operator enters a price through the checkout station terminal so checkout processing may continue. Likewise, the operator may visually detect a surveillance tag on an article and manually activate an EAS tag deactivator for processing the EAS tag. However, neither the price data entry nor the visual detection of the EAS tag results in updates to the product database. Consequently, subsequent scans for other occurrences of the article require another entry of the price data or offline processing of the EAS tag.

What is needed is a way of processing articles through checkout that have attached EAS tags without a corresponding surveillance tag indicator in the product database.

What is needed is a way of updating a product database to modify a surveillance tag indicator to indicate an EAS tag is expected with a scanned article.

What is needed is a way of updating a product database with data for a scanned article that has no corresponding data record in the database.

SUMMARY OF THE INVENTION

The above-noted limitations of previously known checkout stations with EAS tag deactivators have been overcome by a system and method that operate in accordance with the principles of the present invention. The system of the present invention comprises a product database, a surveillance tag interrogator, and a database modifier. The database stores product records corresponding to articles sold in a store and the product records include a surveillance tag indicator. The surveillance tag interrogator generates a surveillance tag present signal in response to detection of a surveillance tag attached to an article submitted for processing at a checkout station. The database modifier is communicatively coupled to the database and the interrogator so it may modify the surveillance tag indicator of a product record in response to the surveillance tag present signal generated by the interrogator. The database modifier, in response to the EAS tag present signal, may set the EAS tag indicator of a product record corresponding to an article being processed for checkout to indicate an EAS tag is expected for the article thereafter. Subsequent queries of the product database using the barcode or other product identification data for the article retrieve a product record with an active surveillance tag indicator. Thus, the system of the present invention updates the surveillance tag indicators of product records in the database to correspond to the detection of EAS tags attached to articles processed at the checkout station.

In one embodiment of the present invention, the interrogator is associated with the EAS deactivator so that the interrogator detects an EAS tag in the EAS deactivator. The detection of EAS tags in the EAS deactivator may be used to detect articles that a consumer may put in the deactivator after visually determining the presence of the EAS tag during checkout. If the surveillance tag indicator of the product record retrieved from the product database with a query incorporating the product identification data obtained by the scanner does not indicate the article should have an EAS tag attached, the database modifier updates the indicator to an active state.

In another embodiment, the interrogator may be associated with the bag well of the checkout station so that the interrogator is located proximately the bag well and detects an active EAS tag in the bag well. This system, preferably, includes a prompter for providing a message to the checkout station operator to place the article with the EAS tag in the deactivator. In response to the EAS tag present signal from the interrogator associated with the bag well, the database modifier updates the surveillance tag indicator for the product record corresponding to the product identification data obtained from the article being processed for checkout.

Preferably, the system of the present invention may be implemented with a checkout station having an interrogator associated with the bag well and another interrogator associated with the EAS deactivator. This system allows the database modifier to activate surveillance tag indicators by setting them to an active state in response to EAS tag present signals from either interrogator. The inclusion of a prompter enables the checkout station operator to be notified of the need for an EAS tag deactivation via an active surveillance tag indicator in a retrieved product record or detection of an EAS tag in the deactivator or the bag well. Preferably, the prompter that may be used in a system incorporating the present invention may be an annunciator, or a display, such as the one typically associated with the terminal of a self-checkout station, or a combination of both.

Preferably, the system of the present invention includes a scanner for reading product identification data from an article being processed for checkout. The product identification data may be used to query the product database for a product record corresponding to the product identification data. In response to no product record being returned, the database modifier generates a product record corresponding to the product identification data read by the scanner. The price data for the generated record may be obtained from data entry at the checkout station and the surveillance tag indicator of the record may be set to an active state if an interrogator generates an EAS tag present signal. Thus, the system of the present invention may be used to generate product records for articles placed in the store before their corresponding data are entered into the product database.

The method of the present invention includes generating a surveillance tag present signal in response to detection of a surveillance tag attached to an article being processed at a checkout station and modifying a surveillance tag indicator in a product record of a product database in response to the surveillance tag present signal. The generation of the surveillance tag present signal may be generated by interrogating a surveillance tag in an EAS deactivator associated with the checkout station or by interrogating a surveillance tag in the bag well of the station. The surveillance present signal may also be used for prompting an operator to perform a surveillance tag deactivation for an active surveillance tag. The prompting action may be in the form of an audible message, a displayed message, or a combination of an audible and visible message.

It is an object of the present invention to enable checkout processing of articles to which surveillance tags are attached despite the lack of an active surveillance tag indicator in the corresponding data record for an article stored in a product database.

It is an object of the present invention to update a product database with data for a scanned article that has no corresponding data record in the database by generating a product record that indicates detection of an active surveillance tag attached to an article corresponding to the product record.

These and other advantages and features of the present invention may be discerned from reviewing the accompanying drawings and the detailed description of the invention.

BRIEF DESCRIPTION OF THE DRAWINGS

The present invention may take form in various system and method components and arrangement of system and method components. The drawings are only for purposes of illustrating exemplary embodiments and are not to be construed as limiting the invention.

DETAILED DESCRIPTION OF THE INVENTION

Figure 1A:
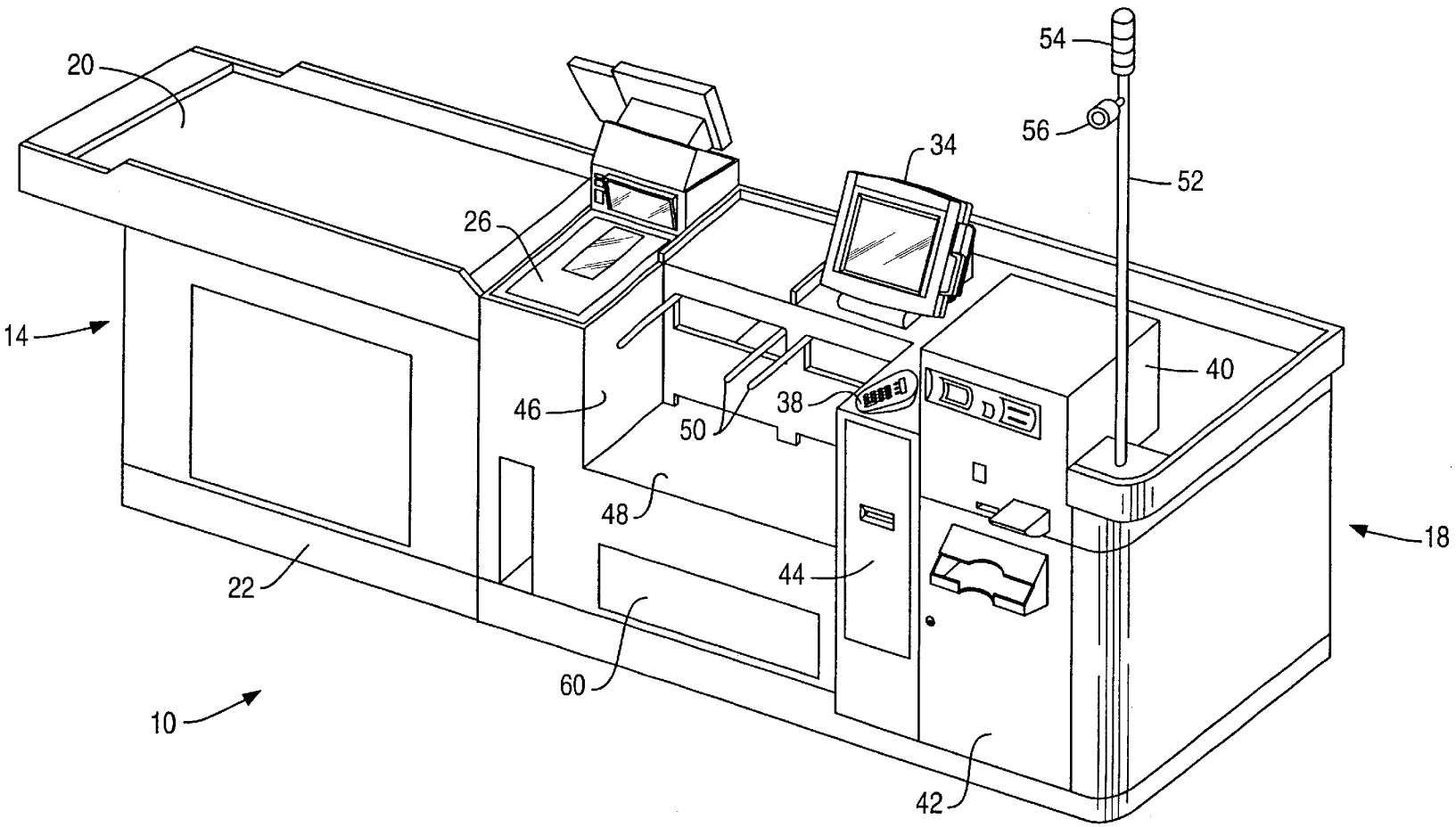
FIG. 1A depicts a typical self-checkout station.

A checkout station incorporating the system and method of the present invention is shown in FIG. 1A. Checkout station 10 may include a feeder unit 14 and a checkstand 18. Feeder unit 14 includes a feeder belt 20 and housing 22 for the motor and control circuitry that operates feeder belt 20. Feeder unit 14 is movably coupled to checkstand 18 so the feeder belt may be aligned with scanner/scale unit 26. Checkstand 18 includes scanner/scale unit 26, consumer terminal 34, a payment terminal 38 for entry of payment data, and receipt printer 44. Scanner/scale unit 26 uses a laser shining on a glass or other transparent platen to input data from bar codes applied to products or packages. Unit 26 may also include a scale for measuring the weight of articles that are sold on a price/unit of weight basis. Consumer terminal 34 displays article data as it is entered through scanner/scale unit 26. Payment terminal 38 may be any known POS terminal that incorporates a keypad and card reader to support credit card, debit card, and other payment methods. Receipt printer 44 provides a consumer with a receipt itemizing the articles purchased and the method of payment.

Receipt printer 44 and scanner/scale unit 26 may be separated by a bag well 46 having a security scale 48 integrated in its floor. Bags for storing articles that consumers have scanned and weighed are hung from hanging rails 50 in bag well 46. Security scale 48 uses article weight data derived from scanner/scale 26 or a database using a scanned unit product code (UPC) to verify that only the articles scanned are placed on the security scale. Security application programs operating within terminal 34 monitor security scale 48 to determine whether articles not scanned have been added to the security scale area. An anomalous condition that requires investigation may be signaled by lighting a warning. or alert light color within the tri-color indicator mounted at the terminal end of indicator pole 52 of checkstand 18. A security camera 56 may be mounted onto indicator pole 52 for providing a video signal to a security officer surveillance area or to some storage media. A database, disk drive, or other computer peripheral required for station operation may be housed within peripheral tray 60 located within checkstand 18. Checkstand 18 also includes upper currency module 40 for receiving currency and coins from a consumer as payment for a transaction. Upper currency module 40 returns the coin portion of a consumer's change while lower currency module 42 returns the bills for a consumer's change.

As shown in FIG. 1A, a consumer may place articles on feeder belt 20 and belt 20 is driven to bring articles to the end of belt 20 where a shut-off mechanism stops belt 20. The consumer may then remove articles from belt 20 and move them, one at a time, over scanner/scale 26 for article product data retrieval from a product database and/or weighing. Alternatively, the consumer may pull a cart containing articles for purchase so it is adjacent feeder unit 22 and place articles from the cart onto scanner/scale 26. The scanned articles may then be placed in bags on security scale 48. Once all of the articles are scanned, a consumer may provide payment through payment terminal 38 or currency module 40, receive change from modules 40 and/or 42, and a receipt from printer 44. The consumer may then remove the bags from security scale 48 and leave station 10.

Figure 1B:
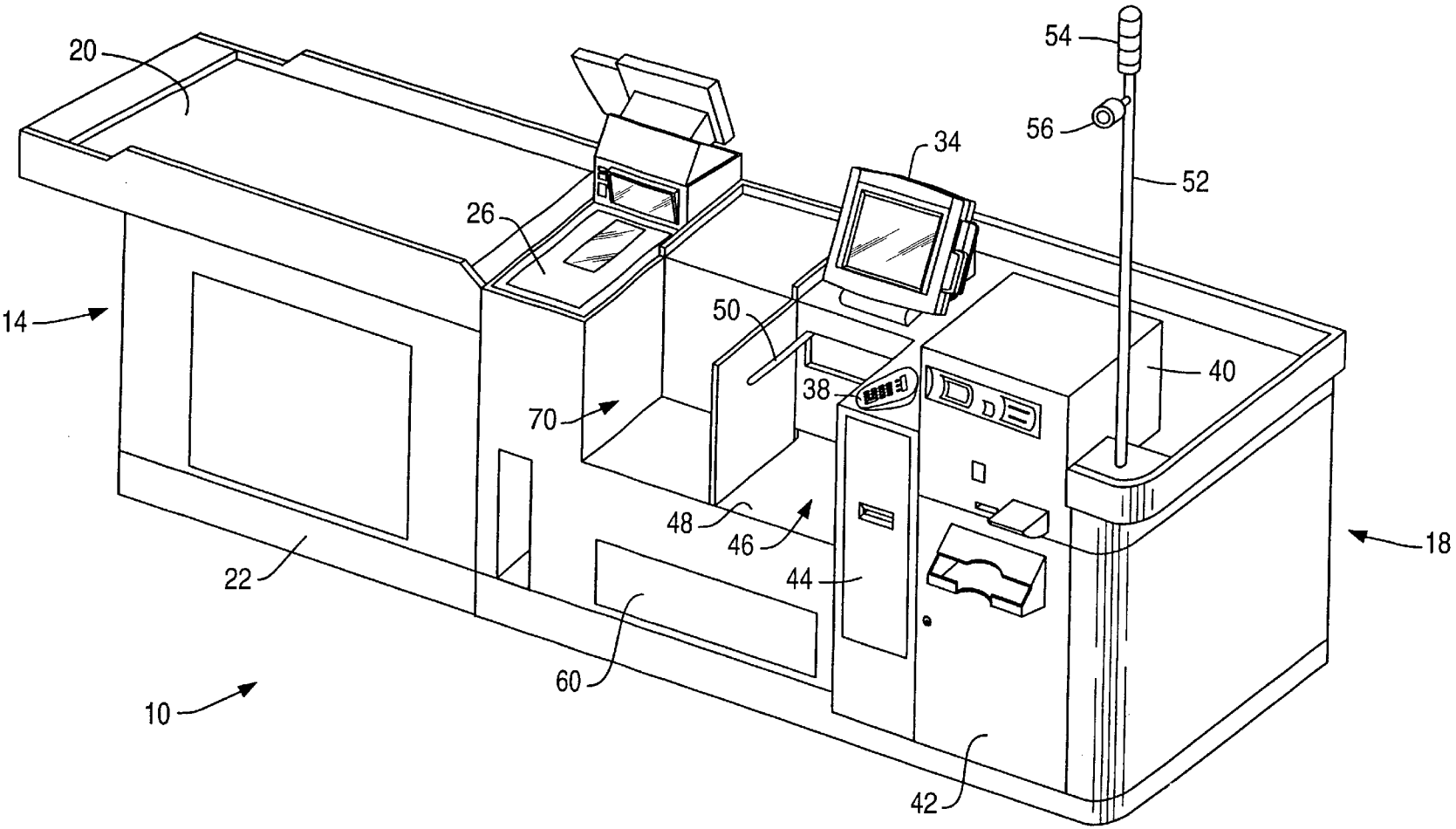
FIG. 1B depicts the self-checkout station of FIG. 1A modified to incorporate the system and method of the present invention.

In one embodiment of the present invention, the self-checkout station of FIG. 1A may be modified to incorporate the system and method of the present invention as shown in FIG. 1B. In FIG. 1B, the portion of bag well 46 adjacent scanner/scale 26 in FIG. 1A is modified to house a surveillance tag deactivator 70 so that the bagging area of bag well 46 is comprised of rack 50 and the portion of bag well 46 adjacent receipt printer 44. In embodiments that separate a cavity for deactivator 70 and bag well 46, security scale 48 may be located so it does not measure weight of articles placed in surveillance deactivator 70 but only those articles that impinge on the floor of bag well 46 as shown in FIG. 1B. In embodiments where bag well 46 and deactivator 70 are integrated, interrogator 108 may be located in an area where bagged articles are placed to detect active surveillance tags.

Figure 2A:
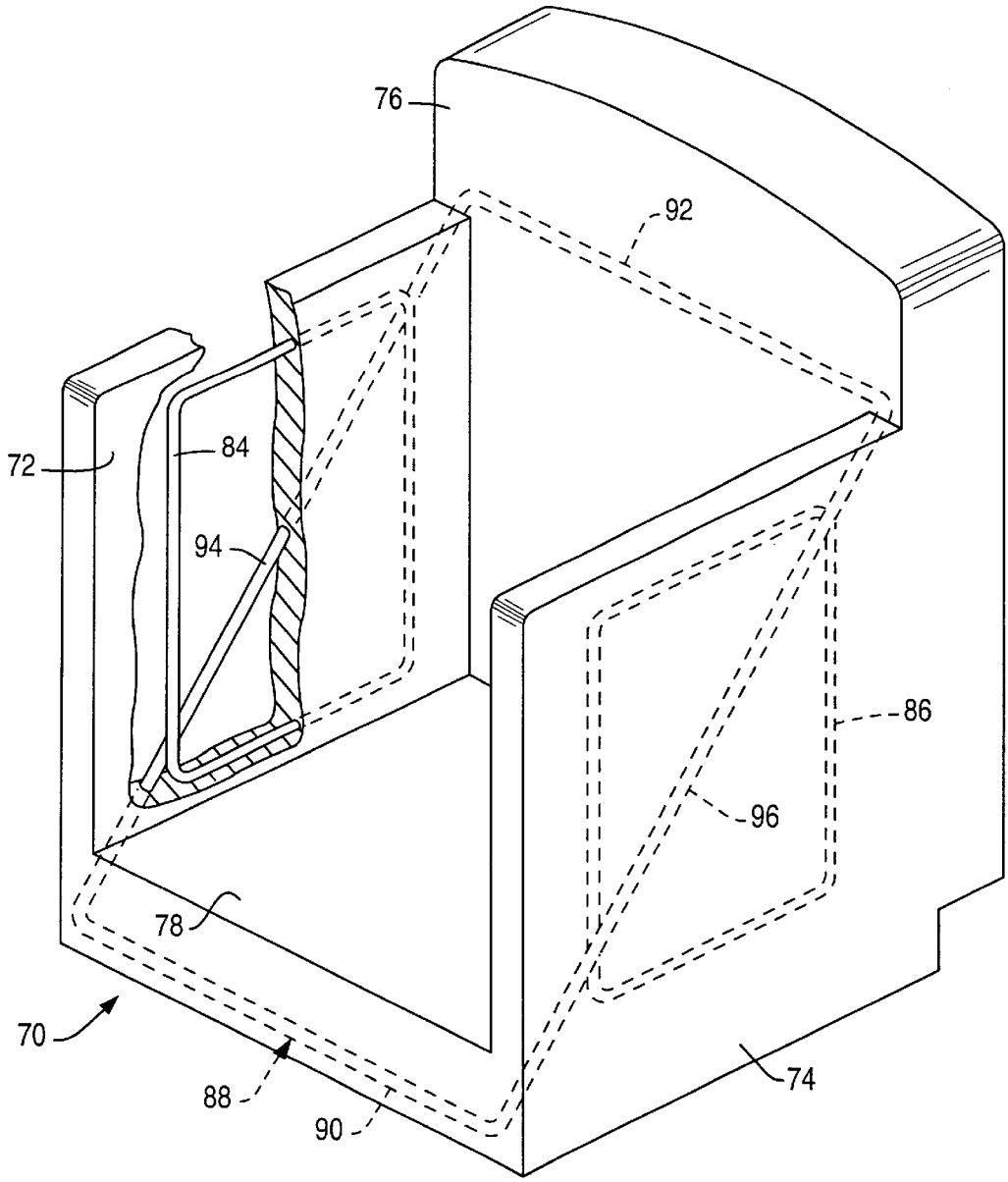
FIG. 2A is a perspective view partially cut away that shows one embodiment of an EAS deactivator that may be used to implement the present invention.

A surveillance tag deactivator 70 for deactivating surveillance tags, such as EAS tags, may be constructed as shown in FIG. 2A. EAS deactivator 70 may include sidewalls 72, 74, back wall 76, and bottom 78. Mounted substantially parallel with sidewalls 72 and 74 are deactivation coils 84 and 86, respectively. Deactivation coil 88 is comprised of diagonal sections 94 and 96 that are joined by section 90 in bottom 78 and section 92 in back wall 76. Electrical energy may be selectively or continually supplied to deactivation coils 84, 86, and 88 for the purpose of deactivating EAS tags on articles placed in EAS deactivator 70. While the embodiment of FIG. 2A emits magnetic fields for the deactivation of magnetic EAS tags, similar embodiments may be constructed for the deactivation of radio frequency (RF or RFID) or intelligent EAS tags. Such embodiments may include antennas for the emission of electrical power at appropriate power levels and/or frequencies for the rupture of a fusible link or the modification of data in a RF, RFID or intelligent EAS tag.

Figure 2B:
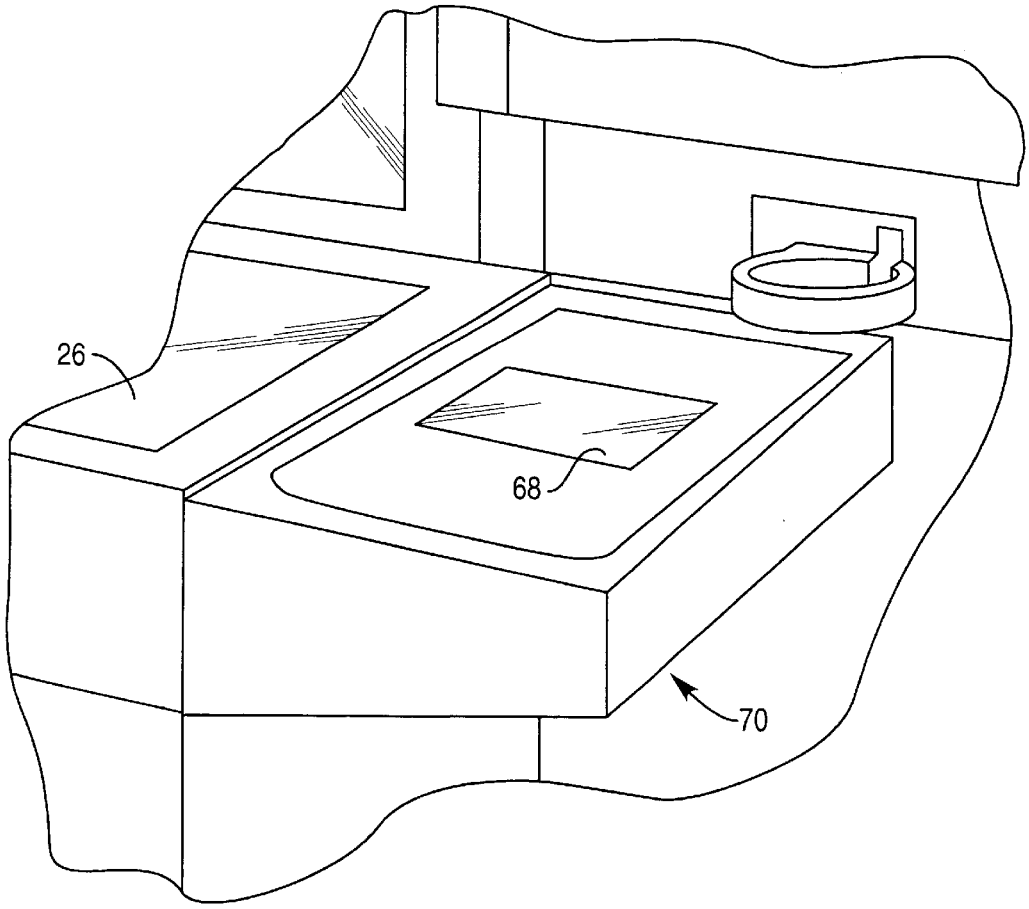
FIG. 2B is a perspective view of a self-checkout station showing a preferred location of an EAS deactivator proximate the scanner of the self-checkout station.

Deactivator 70 may be located proximate scanner 26 of a self-checkout station either as shown in FIG. 1B or FIG. 2B. Deactivator 70 may also be implemented to provide a planar surface for deactivating a surveillance tag.

Preferably, a deactivator 70 having a planar surface for surveillance tag deactivation may be located proximate scanner 26 as shown in FIG. 2B. This embodiment allows a consumer to scan an article and then place the surveillance tag on window or platen 68 of deactivator 70 for deactivating the tag. An interrogator may be located proximate bagwell 46 to detect surveillance tags that were not fully deactivated by the consumer. The interrogator may be located behind the back wall or bottom wall of bag well 46 for detecting surveillance tags.

Figure 3:
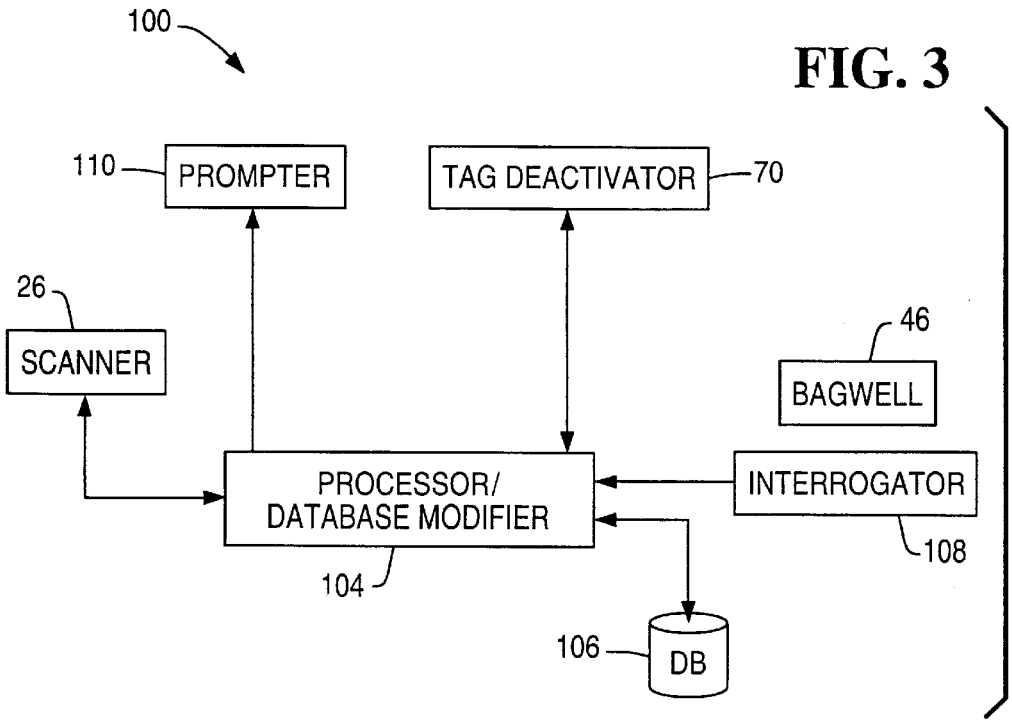
FIG. 3 is a block diagram of a system of the present invention that may be incorporated in the self-checkout station shown in FIG. 1B.

A block diagram of an exemplary system incorporating the principles of the present invention is shown in FIG. 3. System 100 includes a processor/database modifier104 communicatively coupled to scanner 26, a prompter 110, tag deactivator 70, product database 106, and interrogator 108. Processor 104 may be the processor of terminal 34 that controls the operation of station 10 or it may be a processor dedicated to the control of system 100. Processor 104 may be any Pentium processor or the like with sufficient volatile memory and hard disk storage for control of system 100. For example, 64 MB of SDRAM and 4 GB of hard drive storage may be deemed adequate for most applications of the present invention. Also appropriate signal interfaces for performing the control actions described below are required as is well known within the art. The database modifier may be a function implemented in programmed instructions executed by processor 104. Alternatively, the database modifier may be a function of a database management system (not shown) for database 106. Also, the function may be implemented by a computer (not shown) dedicated to the task of modifying product database 106 in response to data received from scanner 26, tag deactivator 70, interrogator 108, and processor 104 either directly or through processor 104. Product database 106 may be located in peripheral tray 60 of checkout station 10 or it may located at a central site so it may be accessible by all or most of the checkout stations in a retail store. If product database 106 is downloaded from a central repository for the store to provide a local copy at a station 10, updates to the local copy of database 106 may be transmitted to the central repository for updating of a master database. Modifications at the master database may then be distributed to the other local copies maintained at other stations in the store. Alternatively, modifications transmitted by database modifier 104 to a central database accessible for querying by all of the stations in a store may be evaluated by the database management system at the central database before modifying the central database.

Figure 4A:
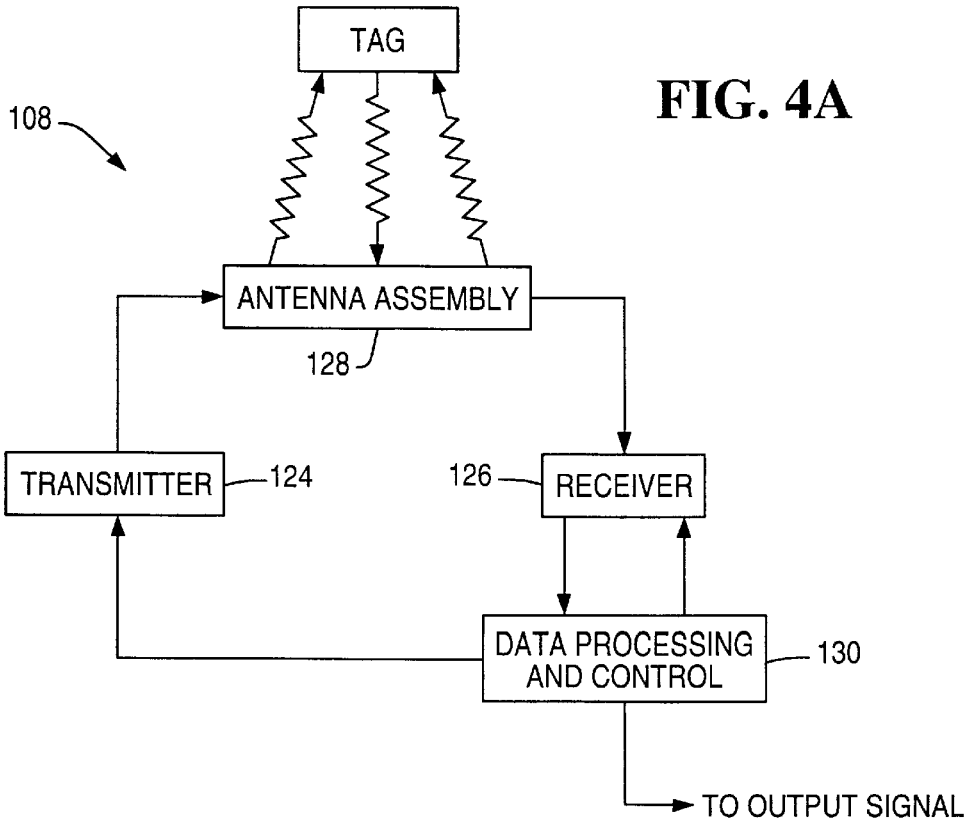
FIG. 4A is a block diagram of an interrogator that may be used with the system and method of the present invention.

Interrogator 108 may be any of a variety of known devices that emit a radio frequency, magnetic field, or microwave transmission for the purpose of ascertaining whether a surveillance tag is present in the vicinity of interrogator 108. An exemplary interrogator that may be used in the system of the present invention is shown in FIG. 4A. Interrogator 108 includes an antenna assembly 128 to which a transmitter 124 and a receiver 126 are coupled. Receiver 124 and transmitter 126 are coupled to and controlled by data processing and control module 130. Under the control of module 130, transmitter 124 provides an electrical signal to antenna assembly 128 for emission. A tag in the emitted field responds with a radiated signal that is converted by antenna assembly 128 into an electrical signal that is provided to receiver 126. The signal may be further conditioned before being provided to control module 130. Preferably, control module 130 of interrogator 108 provides the received signal to processor 104 as an indication that a surveillance tag has responded to the emitted interrogation signal from transmitter 124 and that the ongoing checkout process should be disabled until the surveillance tag has been completely deactivated. Processor/database modifier 104 may use this EAS tag present signal from interrogator 108 to determine whether database 106 should be modified.

In response to the surveillance tag signal from interrogator 108, processor/database modifier 104 may determine whether an active surveillance tag indicator should be added to a new record for the last scanned article or whether the surveillance tag indicator of a retrieved record should be activated. As described in co-pending patent application entitled "System and Method for Verifying Surveillance Tag Deactivation in a Self-Checkout Station," which is owned by the assignee of the present invention, filed on Aug. 30, 2002, processor/database modifier 104 may use the signal from interrogator 108 to disable the checkout process. That application is hereby expressly incorporated in the present application. As explained in that application, processor/database modifier 104 may confirm complete deactivation of a surveillance tag by disabling the checkout process. Specifically, processor/database modifier 104 may disable the operation of scanner 26, ignore further data received from scanner 26, suspend product database queries, or suspend the accumulation of price or subtotal data at checkout station 10. Additionally, processor 104 may inform the consumer of the need to completely deactivate the surveillance tag placed in the vicinity of interrogator 108 by providing a prompting signal to prompter 110.

Prompter 110 may be an annunciator, a visual display such as the display associated with terminal 34 of checkout station 10, or a combination of an annunciator and visual display. The visual data may include a statement informing the consumer of the need to place the last scanned article with the surveillance tag in tag deactivator 70 for complete deactivation. Alternatively, prompter 110 may emit an audible message, either in voice or tone form, to alert the consumer to the need for deactivating the EAS tag. Preferably, prompter 110 includes audible and visual components to attract the consumer's attention to the active surveillance tag. The suspension of checkout processing should direct the consumer's efforts to the problem with the last scanned article or lead to consultation with a self-checkout attendant for assistance. Should the consumer withdraw the article with the active surveillance tag from checkout, scale 48 detects the absence of the last scanned article from bag well 46 and may send a signal to processor/database modifier 104 indicating the anomaly. In response, processor/database modifier 104 may display or announce a message to the consumer requesting that the consumer delete the last scanned article from the checkout process so the process may continue. In this manner, a consumer may withdraw an article from the checkout process without requiring attendant assistance.

Figure 4B:
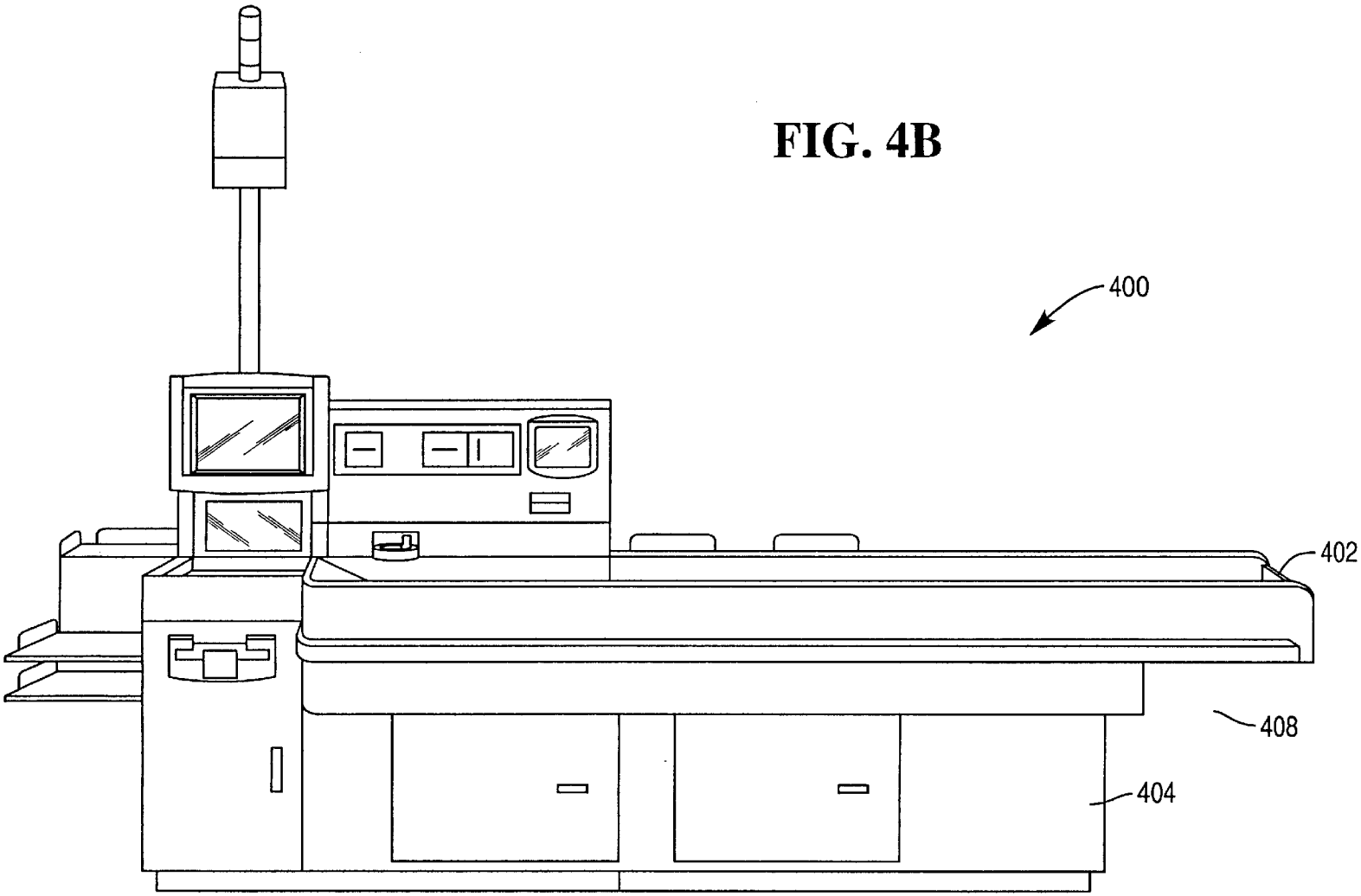
FIG. 4B is a perspective view of a self-checkout station with a take away module in which an interrogator may be located for detecting surveillance tags on scanned articles.

Interrogator 108 may be incorporated within bag well 46 as explained above to detect surveillance tags. In self-checkout stations having a take away belt for scanned items, such as station 400 shown in FIG. 4B, interrogator 108 may be placed proximate outboard end 402 of take way belt module 408 to detect active surveillance tags. For example, an interrogator 108 may be located in housing 404 underneath the traveling belt of take away belt module 408 to detect surveillance tags as articles travel along the belt so a consumer may be warned of articles having active tags before bagging the articles.

Figure 5:
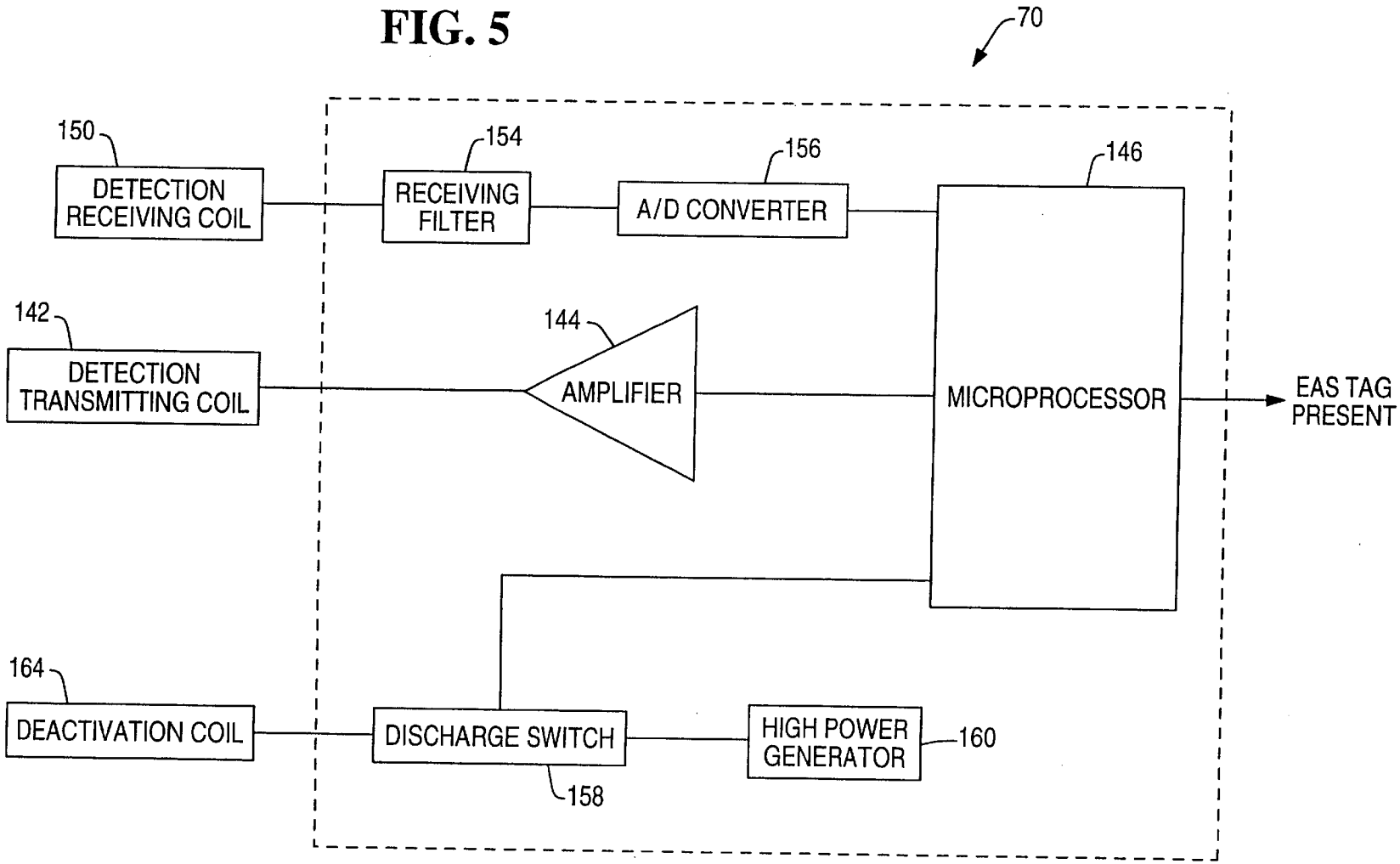
FIG. 5 is a block diagram of an EAS tag deactivator that may be used in the system of FIG. 3.

Preferably, tag deactivator of system 100 includes an interrogator such as interrogator 108 along with the deactivation circuitry and controller. As shown in FIG. 5, surveillance tag deactivator 70 may include an interrogating signal transmission coil 142 that is driven by an amplifier 144 under control of microprocessor 146. The emitted response of a surveillance tag is delivered by detection receiving coil 150 to receiving filter 154 for extraction of the surveillance tag response signal. The extracted response signal is converted to a digital form for microprocessor 146. In response, microprocessor 146 may generate the surveillance tag present signal that may be provided to processor/database modifier 104 for a determination regarding modification of database 106 or other control actions. Also, microprocessor 146 may activate switch 158 to couple power source 160 to deactivation coil 164. When the tag that is generating the surveillance response signal is deactivated by the emission from coil 164, the surveillance tag no longer responds to the signal from transmitting coil 142 and the extracted response signal is not supplied to microprocessor 146. As a consequence, switch 158 is deactivated and deactivation coil 164 is de-coupled from power source 160. Unfortunately, termination of the signal from deactivation coil 164 also occurs in response to the removal of the article to which the surveillance tag is attached from the vicinity of detection coil 150. Hence the proximity of interrogator 108 to bag well 46 permits system 100 to detect surveillance tags that have not been deactivated so the surveillance tag present signal may be generated and the need for database modification evaluated. Detection of surveillance tags at the checkout station may be used to activate the surveillance tag indicator of a new or existing product data record. The signal may also be used as a checkout disable signal to suspend the checkout process and encourage the consumer to return the article with the surveillance tag to deactivator 70 for completion of the deactivation process.

Figures 6A, 7:
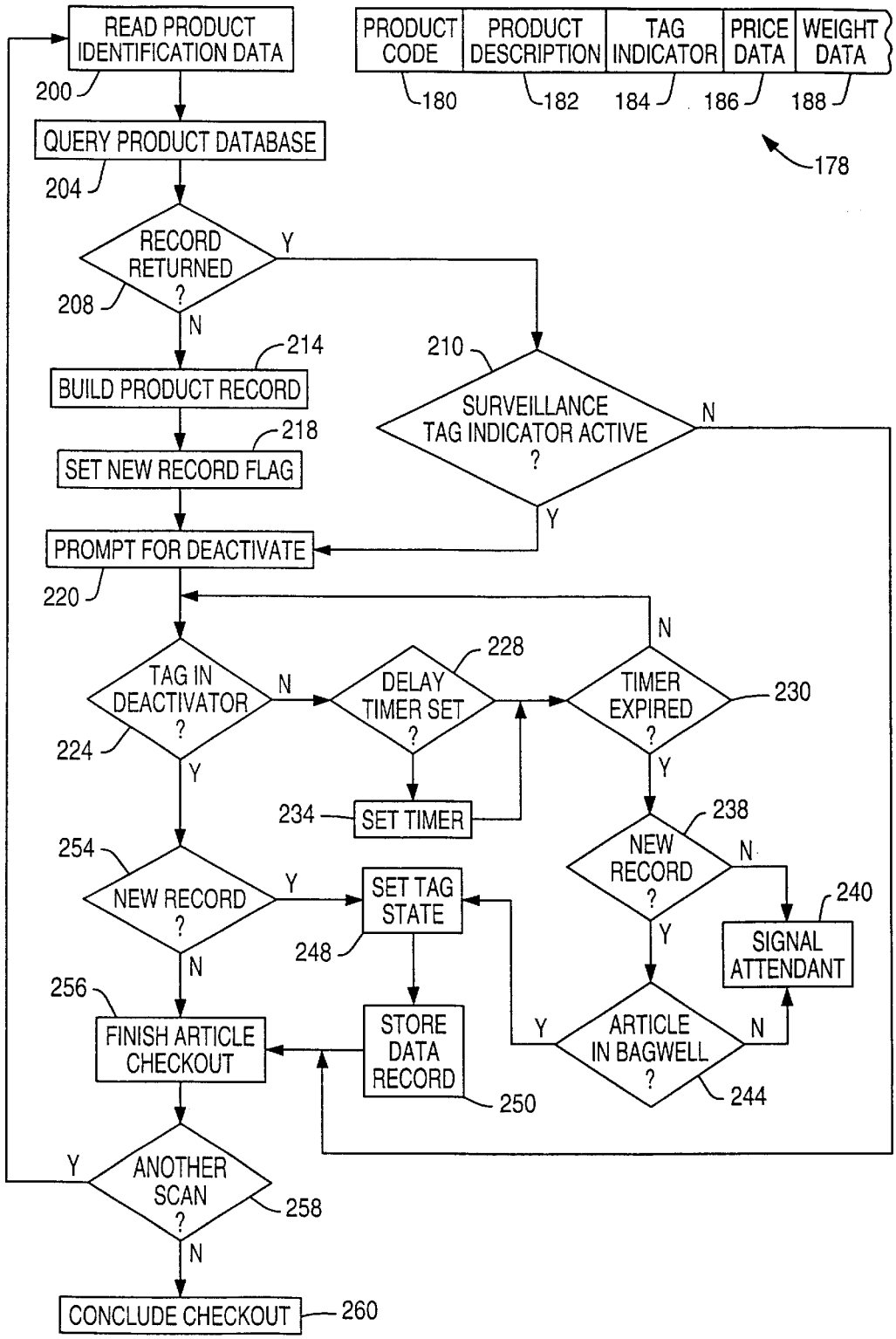
FIG. 6A is a flowchart of an exemplary method that may be used in a system incorporating the principles of the present invention that has a single surveillance tag interrogator.
FIG. 7 is a diagram of a portion of an exemplary product data record that may be used in the database of a system of the present invention.

An exemplary method that may be used with the system of the present invention is shown in FIG. 6A. The method begins by checking for a scan of an article (block 200). Once a scan is detected, the product code read by scanner 26 or entered through terminal 34 may be used to query database 106 for a corresponding product record (block 204). A determination is made as to whether a corresponding product record was returned (block 208). A depiction of a portion of an exemplary data record 178 is shown in FIG. 7. The record includes the product code 180 that may be used as a key for the record in a relational database. The exemplary record may also include a description field 182, a surveillance tag indicator 184, price data 186, and weight data 188. While the exemplary record structure is shown as a relational database record, database 106 may be an object repository and a product record may be structured accordingly as is well known in the art.

If a record is returned in response to a database query, the surveillance tag indicator 184 of the retrieved record is examined to determine whether it is active (block 210). An active surveillance tag indicator means a surveillance tag should be coupled to the scanned article and deactivation is required. If indicator 184 is inactive, an article not expected to have an EAS attached to it has been scanned and it is processed for checkout (block 256) as is well known before determining whether another article has been scanned (block 258). If surveillance tag indicator 184 is active, a prompt is provided to the station operator via prompter 110 advising the operator that the EAS tag requires deactivation and the article is to be placed in deactivator 70 (block 220). If no record was returned in response to the database query incorporating the scanned product code, database modifier 106 is activated to build a product data record for the last scanned article (block 214). A build new record variable is set to indicate a new database record is being constructed (block 218). The operator is prompted to place the article in deactivator 70 so system 100 may determine whether an EAS tag is attached to the article (block 220).

The method determines whether an EAS tag is present in deactivator 70 (block 224). If it is not, the method determines whether a delay timer has already been set (block 228). If the timer has been set, the method determines whether the timer has expired (block 230). Otherwise, the timer is set (block 234) and checked to see if it has expired (block 230). The method continues to evaluate whether an EAS tag is detected in deactivator 70 (block 224) until the delay timer expires (block 230). If the timer expires without detection of an EAS tag in deactivator 70, the method determines whether a new database record is being built (block 238). If one is not being generated a checkout manager or checkout attendant is signaled for operator assistance (block 240) because an expected EAS tag has not been submitted for deactivation. If a new record is being generated, the method determines whether the article is in bag well 46 (block 244). As is well known, scale 48 and weight data 188 may be used to verify the placement of the last scanned article in bag well 46. For an article not having a corresponding product record in database 106, a weight differential measured at scale 48 may be used to confirm placement of the article in bag well 46 and the weight differential is written as weight data 188 for the new record being constructed. If the article is not detected as being in bag well 46, a checkout manager or attendant is signaled for operator assistance (block 240) because the article has been improperly withdrawn from the checkout process. If the article is in bag well 46 and a new record is being constructed, the surveillance tag indicator is set to an inactive state (block 248) because no EAS tag was detected for the article. The product code, surveillance tag indicator, and weight data may be used to construct at least a partial product record for the last scanned article and the record is stored in database 106 by database modifier 104.

If an EAS tag was detected in deactivator 70, the method determines whether a new record is being generated (block 254). If it is not, the article may then be processed for checkout as is well known (block 256). Preferably, checkout processing includes the method disclosed in the application expressly incorporated above to verify the deactivation of the EAS tag detected as being attached to the article. If a new record is being generated, surveillance tag indicator is set to an active state (block 248) and at least a partial product data record is constructed and stored in database 106 by modifier 104 (block 250). After the checkout processing for the last scanned article is complete, the method determines whether another scan is being performed (block 258). If an article is being scanned, the method processes the article beginning with the reading of the product code (block 200). If no other scan is detected, the checkout process is completed (block 260) as is well known.

Figure 6B:
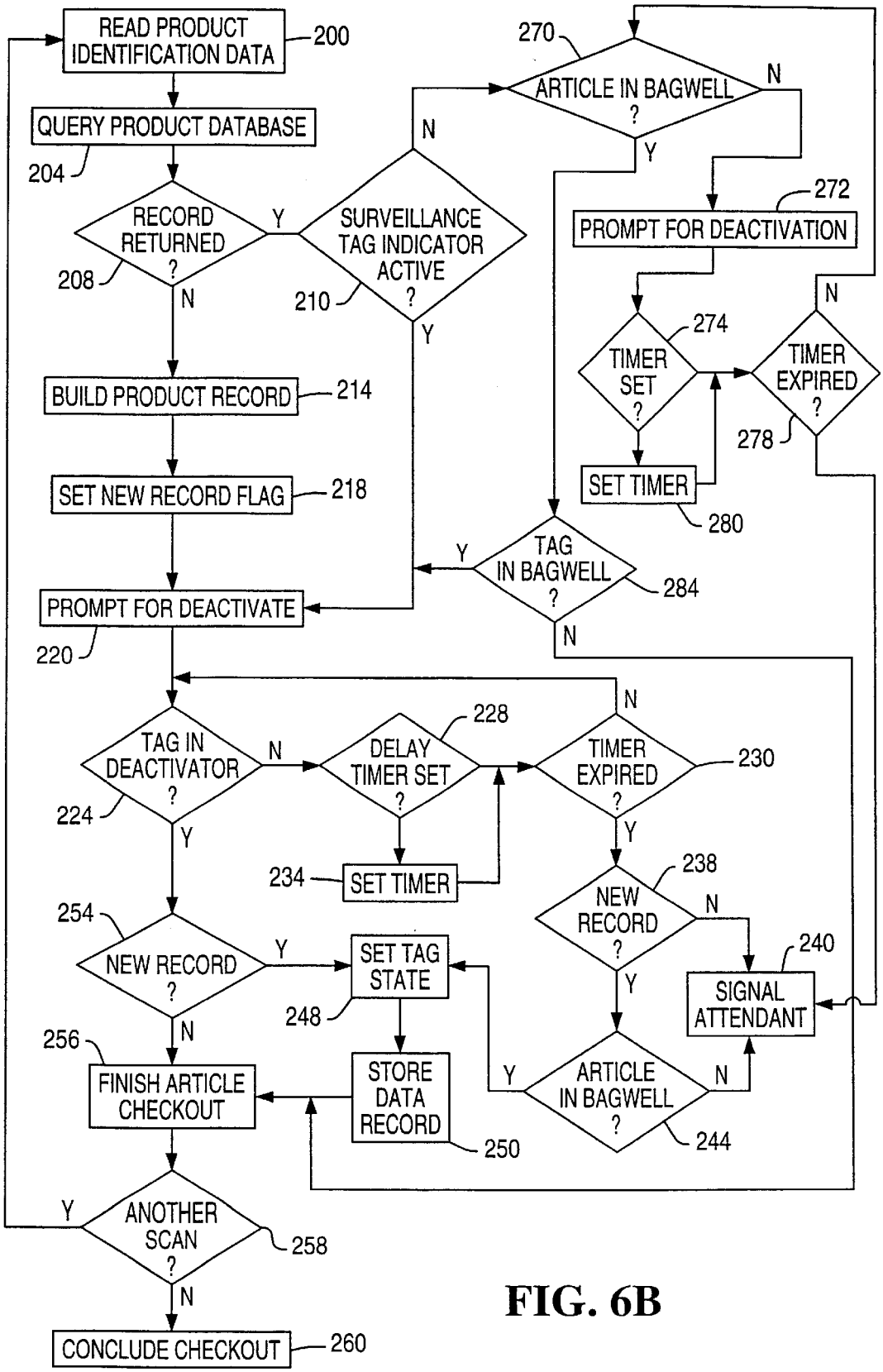
FIG. 6B is a flowchart of an exemplary method that may be used in a system incorporating the principles of the present invention that includes two surveillance tag interrogators.

An embodiment having two interrogators, one preferably associated with EAS deactivator 70 and the other associated with bag well 46 so the two interrogators are located proximate the EAS deactivator 70 and bag well 46, may use the exemplary method depicted in FIG. 6B. That method is similar to the method of FIG. 6A except both interrogators may generate a surveillance tag present signal in response to an EAS tag being in either the EAS deactivator 70 or bagwell 46. The process operates as the one described with respect to FIG. 6A with the addition of evaluating and responding to the presence or absence of an article and EAS tag in bag well 46. That processing includes an evaluation as to whether scale 48 indicates an article has been detected in bag well 46 (block 270). If one has not been detected, a prompt is provided to the operator to either withdraw the article from the checkout process or place it in the bagwell (block 272). The process may then determine whether a delay timer has been set (block 274) and if one has, whether it has expired (block 278). If the timer expires before an article is detected in the bag well, a checkout attendant or manager is signaled (block 240). If no timer has been set, it is initialized with a delay time value (block 280) and checked to see if the timer has expired (block 278). If the article is detected as being in the bag well through an increase in weight at the bag well or other known detection scheme, the process determines whether an EAS tag is attached to the article (block 284). If a surveillance tag is not present in the bag well, the process continues the checkout process in a known manner that is preferably augmented with the method for verifying deactivation of the surveillance tag as disclosed in the application expressly incorporated by reference above (block 256). Otherwise, a prompt is issued to the operator to place the article with the EAS tag in the deactivator (block 220) and the process continues as discussed above with reference to FIG. 6A.

In operation, a self-checkout station with access to a product database is modified to include an EAS deactivator and at least one interrogator for detecting active EAS tags in the bag well. Preferably, the EAS deactivator is located between the scanner and the bag well of the checkout station to facilitate access to the deactivator and encourage its use by the consumer. The program for interfacing a processor with a database modifying function to the interrogator, deactivator, and other station components is then loaded into memory or otherwise made available for execution by the processor as is well known. Thereafter, scanning or otherwise entering a product code results in a query of the product database for a corresponding product record. If one is not returned, the database modifier builds a product record from the data acquired for the article during the checkout process and stores the new record into the product database. If a record is retrieved, the record is parsed to determine whether the article should have an EAS tag attached to it and if one should be present, prompt the operator to deactivate the tag. If the record indicates no EAS tag should be attached to the article but one is detected, either at the EAS deactivator or bag well, the surveillance tag indicator of the returned product record is modified to an active status and stored in the database. In this manner, articles that are unexpectedly detected as having an attached EAS tag result in the updating of the surveillance tag indicator in the product data record corresponding to product code for the last scanned article. Likewise, the detection of articles for which no data record exists in the database causes the generation of a data record for the last scanned article.

While the present invention has been illustrated by the description of exemplary processes and system components, and while the various processes and components have been described in considerable detail, applicant does not intend to restrict or in any limit the scope of the appended claims to such detail. For example, the system and method of the present invention have been generally described in relation to a self-checkout station, however, the system and method may be incorporated within an attendant operated checkout station. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for modifying a database in response to detection of surveillance tags at a checkout station comprising:

a product database for storing product records corresponding to articles sold in a store, the product records including a surveillance tag indicator;

a surveillance tag interrogator at the checkout station for generating a surveillance tag present signal during a transaction in response to detection of a surveillance tag attached to an article submitted for processing at the checkout station; and a database modifier communicatively coupled to the database and interrogator for sending a query containing product identification data associated with the article, if a record is returned by the database, for determining whether a surveillance tag indicator in the record is active, indicating that the surveillance tag should be attached to the article and deactivation is required, or inactive, indicating that the surveillance tag should not be attached to the article, but that deactivation is still required; and if no record is returned from the database, for generating a new data record for the database, and for setting an active surveillance tag indicator in the new data record during the transaction, indicating that deactivation is required.

2. The system of claim 1 wherein the interrogator is located proximate a surveillance tag deactivator at a checkout counter so that the interrogator detects the surveillance tag in the the surveillance tag deactivator.

3. The system of claim 1 further comprising:

a scanner at the checkout station for obtaining the product identification data associated with the article being submitted for checkout processing.

4. The system of claim 1 further comprising:

a prompter at the checkout station for prompting deactivation of the surveillance tag attached to the article during the transaction in response to the surveillance tag present signal.

5. The system of claim 4 wherein the prompter is a display for providing a visual prompt regarding surveillance tag deactivation during the transaction.

6. The system of claim 4 wherein the prompter is an annunciator for providing an audible prompt regarding surveillance tag deactivation during the transaction.

7. A method for modifying a database in response to the detection of surveillance tags at a checkout station comprising:

receiving product identification data for an article being submitted for checkout processing during a transaction from a scanner by a computer at the checkout station;

sending a query containing the product identification data read by the scanner to the database by the computer;

receiving a surveillance tag present signal from a surveillance tag interrogator at the checkout station in response to detection of a surveillance tag attached to the article being processed at the checkout station during the transaction by the computer; and if a record is returned by the database, determining whether a surveillance tag indicator in the record is active by the computer, indicating that the surveillance tag should be attached to the article and deactivation is required, or inactive by the computer, indicating that the surveillance tag should not be attached to the article, but that deactivation is still required; and if no record is returned from the database, generating a new data record for the database by the computer; and setting an active surveillance tag indicator in the new data record during the transaction by the computer, indicating that deactivation is required.

8. The method of claim 7 further comprising:

prompting for deactivation of the surveillance tag attached to the article being submitted for checkout processing in response to the surveillance tag present signal.

9. The method of claim 8 wherein the prompting displays a visual prompt regarding surveillance tag deactivation.

10. The method of claim 8 wherein the prompting annunciates an audible prompt regarding surveillance tag deactivation.

11. The system of claim 2 wherein the interrogator is located proximate a bag well of the checkout station.

12. The method of claim 7 wherein the interrogator is located proximate a bag well of the checkout station.

13. A method for modifying a database in response to the detection of surveillance tags at a checkout station comprising:

receiving product identification data for an article being submitted for checkout processing during a transaction from a scanner by a computer at the checkout station;

receiving a surveillance tag present signal from a surveillance tag interrogator in a bag well at the checkout station in response to detection of a surveillance tag attached to the article being placed in the bag well during the transaction by the computer; and sending a query containing the product identification data read by the scanner to the database by the computer;

if a record is returned by the database, determining whether a surveillance tag indicator in the record is active by the computer, indicating that the surveillance tag should be attached to the article and deactivation is required, or inactive by the computer, indicating that the surveillance tag should not be attached to the article, but that deactivation is still required;

if no record is returned from the database, generating a new data record for the database by the computer; and setting an active surveillance tag indicator in the new data record during the transaction by the computer, indicating that deactivation is required; and prompting for deactivation of the surveillance tag attached to the article in response to the surveillance tag present signal by the computer.

14. A system for modifying a database in response to detection of surveillance tags at a checkout station comprising:

a product database for storing product records corresponding to articles sold in a store, the product records including a surveillance tag indicator;

a scanner at the checkout station for reading product identification data for an article being submitted for checkout processing;

a surveillance tag interrogator at the checkout station for generating a surveillance tag present signal during a transaction in response to detection of a surveillance tag attached to the article submitted for processing at the checkout station; and a database modifier communicatively coupled to the database and interrogator for sending a query containing the product identification data read by the scanner, if a record is returned by the database, for determining whether a surveillance tag indicator in the record is active, indicating that the surveillance tag should be attached to the article and deactivation is required, or inactive, indicating that the surveillance tag should not be attached to the article, but that deactivation is still required; and if no record is returned from the database, for generating a new data record for the database, and for setting an active surveillance tag indicator in the new data record during the transaction, indicating that deactivation is required.

* * * * *